United States Patent [19]

Höhne et al.

[11] Patent Number: 4,480,664

[45] Date of Patent: Nov. 6, 1984

[54] ELECTROMAGNETICALLY CONTROLLABLE COUPLING MEANS FOR THE DRIVE SHAFT OF A TEXTILE MACHINE

[75] Inventors: Hans-Jürgen Höhne, Hainburg; Kresimir Mista, Heusenstamm, both of Fed. Rep. of Germany

[73] Assignee: Karl Mayer Textilmaschinenfabrik GmbH, Fed. Rep. of Germany

[21] Appl. No.: 503,652

[22] Filed: Jun. 13, 1983

[30] Foreign Application Priority Data

Jun. 16, 1982 [DE] Fed. Rep. of Germany ..... 3222581

[51] Int. Cl.[3] ..... D03C 1/00

[52] U.S. Cl. ..... 139/76; 139/455

[58] Field of Search ..... 139/55.1, 455, 66 R, 139/59, 76

[56] References Cited

U.S. PATENT DOCUMENTS

| | | | |
|---|---|---|---|
| 3,817,292 | 6/1974 | Doehler et al. | 139/455 |
| 3,835,894 | 9/1974 | Speich | 139/59 |
| 4,427,035 | 1/1984 | Hintsch et al. | 139/76 |

FOREIGN PATENT DOCUMENTS

| | | | |
|---|---|---|---|
| 2166585 | 4/1971 | Fed. Rep. of Germany | 139/455 |
| 277250 | 2/1948 | Switzerland | 139/76 |

*Primary Examiner*—Henry Jaudon
*Attorney, Agent, or Firm*—Omri M. Behr

[57] ABSTRACT

There is provided an electromagnetically controllable coupling means between the drive shaft and a cam element of a textile machine. A latch mounted on the cam element and rotatable with it is biasable by a spring to interact with grooves in said drive shaft. Two rocker arms rotatable about fixed axes are each provided with a strikers and are swingable back and forth between a first position in which said striker holds the latch out of interaction with the grooves and a second position in which the latch is released in order to interact with said grooves. A pair of anchors influenced by program directed electromagnets serve to hold the said rocker arms in the first position. A stopping arrangement prevents further rotation of the cam means when the latch moves from one into the other of the aforementioned rotation positions. Each anchor attached to the appropriate arm is in the first position of the rocker arm presented proximate to the pole face of its appropriate electromagnet. The electromagnets are provided with a permanent magnetic field and a charge winding which when, activated causes the anchors, because of the spring biasing action upon the arm, to move out of contact with said electromagnet.

9 Claims, 3 Drawing Figures

Fig. 2
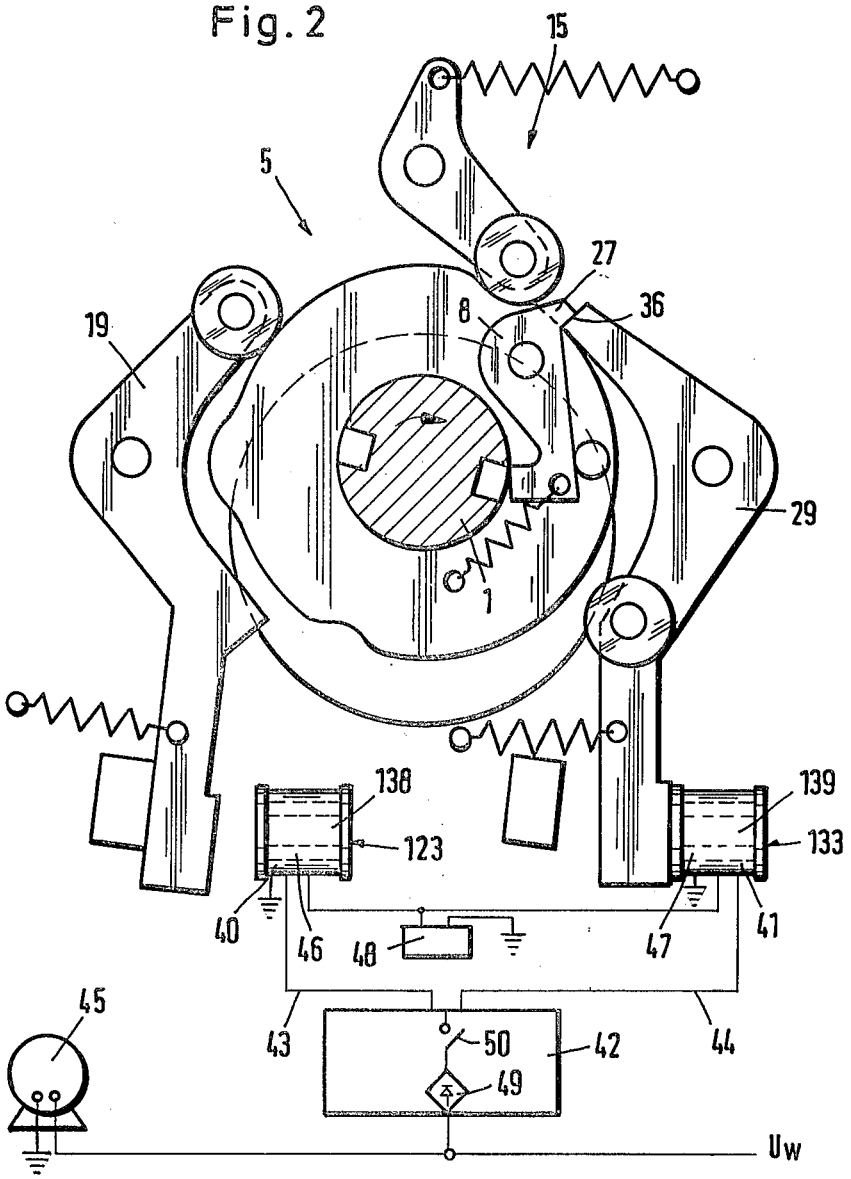
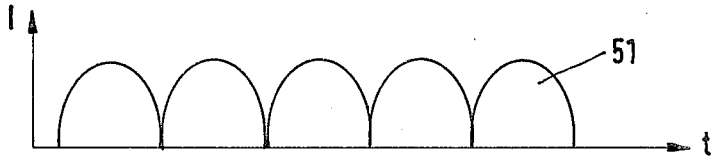
Fig. 3

ELECTROMAGNETICALLY CONTROLLABLE COUPLING MEANS FOR THE DRIVE SHAFT OF A TEXTILE MACHINE

BACKGROUND OF THE INVENTION

The invention is concerned with electromagnetically controllable couplings connecting the drive shaft of a textile machine with a cam means operating to control the displacement of the guide bars. These couplings are electromagnetically controlled by the interaction of an electromagnet and an anchor means attached to the coupling means.

In a coupling means of the art (German patent DE-PS No. 27 41200 FIG. 4) the anchor provided to each electromagnet stops the movement of an intermediate lever in the inactive position, said intermediate lever controlling a latch which interacts between the coupling means and the drive shaft itself. When the programming arrangements provides activation current to the electromagnet and the anchor is attracted, the intermediate lever is freed and the rocker arm biased by a spring attached thereto, moves into a second position in which it no longer acts upon the latch. This mode of construction requires a plurality of interacting parts, this in turn limits the working speed of the device. The stopping of the intermediate lever is effected by an edge which, in time, will become abraded. The safety factor thus will eventually be reduced. In order to insure that the anchor is certain to be attracted, it is necessary to utilize a relatively large activation current. This, of course, requires the use of a relatively more substantial activation winding.

When the coupling is utilized to obtain a particular, patterning for example, by combination with similar couplings to influence the displacement movement of a guide bar of a warp knitting machine (for example, Germany published application DE AS No. 2610888) a further disadvantage occurs in that in the event of subsequent power failure or other emergency switch off of the machine, the orientation of the rocker arm can no longer be controlled. The appropriate cam elements therefore are in an uncertain position and thus on reactivation of the machine pattern confusion will result.

The problem to be solved therefore, is to provide a coupling of, a type heretofore described which is simpler in construction, avoids the problem of current failure and is operable with a lower activation current.

SUMMARY OF THE INVENTION

The general structure of the coupling means of the present invention may be described as follows. The drive shaft of a textile machine is provided with, suitably, a pair of longitudinal grooves spaced 180° from each other. Rotatably mounted around the shaft is a cam means comprising a spring biased latch interactable with said grooves. There are provided a pair of rocker arms rotatable about fixed axes on either side of the drive shaft. The said levers are provided with means for interacting with the aforesaid latch so as to enable it to move in and out of said grooves in the shaft. The cam means is provided with a protrusion which is interactable with said rocker arms so that said spring biased arms can be moved from a first position in which the latch interacts with a first one of the grooves into a second position where the latch is freed from interaction from said first one of the grooves. There are further provided a pair of program controlled electromagnets which can act upon respective anchors of said rocker arms and there is yet further provided a stop mechanism which will hold the cam means in the one of two predetermined positions upon liberation of the latch means.

The problem posed is solved in the present invention by providing that each anchor is rigidly fixed to its appropriate rocker arm, and that in the aforesaid first positon of the rocker arm said anchor is directly presented to the pole face of the electromagnet. It is further provided that the electromagnet is provided with a permanent magnetic field and a discharge winding which, upon activation permits the anchor on the rocker arm to be drawn away therefrom under the bias of the spring attached to said rocker arm.

Since the rocker arm and the anchor are rigidly interconnected there is provided on one hand an extremely simple mode of construction which permits high working speeds and which possess a very substantial safety factor and on the other hand provides a proximate presentation of the anchor to the pole of the electromagnet so that the magnetic forces necessary to hold the anchor in place can be comparatively small. Similarly the activating current which must be lead to the discharge winding in order to release the rocker arm into the second setting may equally be small.

Since the anchor may be held fast by the electromagnet in the first position of the rocker arm it is not necessary to employ any stopping edges or the like which, in course of time, may become abraded. If it is further provided that the permanent magnetic field is independent of the general power circuit, patterning chaos after a sudden stop may also be avoided. Under the circumstances of this invention in the case of power failure or power interruption, the permanent magnetic field remains in force. In consequence thereof the rocker arms whose anchors are held to the electromagnets are held to the first positon and the rocker arms whose anchors are in the free position equally remain in the second setting. When power is restored an orderly matter of pattterning may proceed.

The simplest mode of providing circuit independence is to form the core of the electromagnet out of permanent magnetic material. Instead of this or additional thereto the electromagnets may be provided with a circuit-independent source of direct current, for example from batteries or accumulators which activate the holding winding.

Furthermore, it is advantageous to provide that the cam element has only one protrusion on the circumferential edge opposite to the location of the latch. One such protrusion will suffice. Each rocker arm is only moved into the first position for each rotation of the cam means. It is advantageous to provide a striker means to the rocker arm in order to fix the location of the second position. This may be so chosen so that the movement of the rocker arm is as small as possible.

It is particularly advantageous to provide that the activation current for the discharge winding is dependent upn the current in the general circuit. When no circuit current is available the activating current will also fail, this insures that during a circuit failure the permanent magnetic field is not distrurbed.

It is further advantageous to provide that the activation current for the discharge winding comprises a sequence of impulses. This provides a greater assurance that the anchor is indeed released. Thus, the discharge winding need only be designed for thermal loading during the effective passage of current therethrough whereas for the weakening of the permanent magnetic field the higher amplitude of the impulse is the more important factor.

In particular the impulse series can be obtained by full wave rectification of the alternating circuit current. There is thus provided a sine wave impulse every 10 milliseconds. No additional impulse forming step is necessary.

The invention is illustrated in the accompanying drawings which illustrate the preferred embodiments thereof.

BRIEF DESCRIPTION OF THE DRAWINGS

FIG. 2 is a cross sectional elevational view of the coupling in a second working position.

FIG. 3 is a graph of current against time showing the flow of the activating current.

DESCRIPTION OF THE PREFERRED EMBODIMENTS

Figure 1:
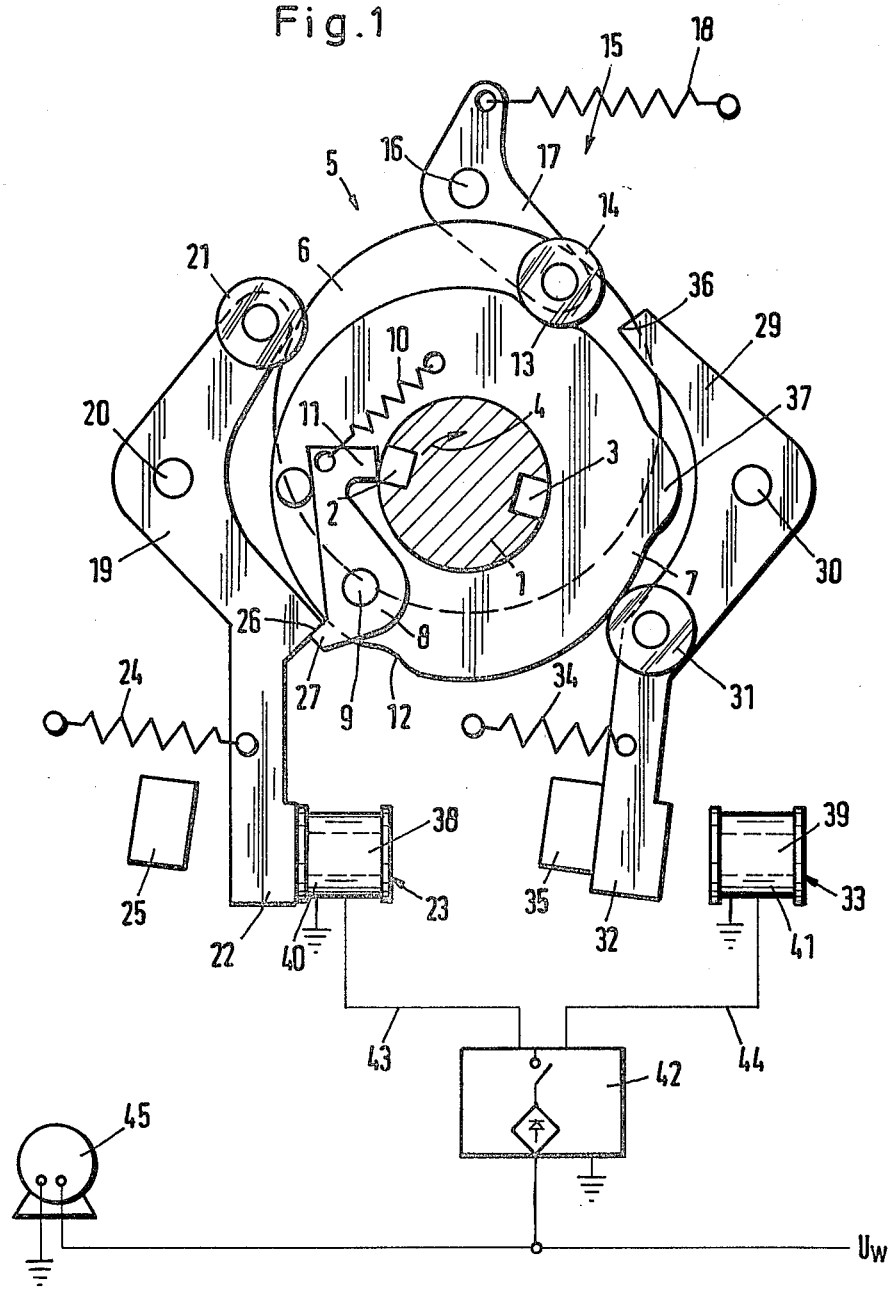
FIG. 1 is a cross-sectional elevational view of an embodiment of the coupling means in a first working position.

The apparatus comprises a drive shaft 1 provided with longitudinal grooves 2 and 3 provided in the circumference thereof. The drive shaft 1 is axially rotatable in the direction of arrow 4, suitably in an intermittent fashion in 180° steps. This rotation is suitably dependent upon the rotation of the main shaft of a textile machine such as a warp knitting machine. Cam element 5 is journalled upon shaft 1 to be rotatable around it. This cam element 5 comprises an eccentric 6 and a cam plate 7. A latch means 8 is rotatably mounted upon axle 9 which is attached to cam means 5. Latch means 8 is provided at one end thereof with a nose 11, formed to be engagable the grooves 2 and 3 and at the other end thereof, more proximate to axle 9, with a protrusion 27. Spring means 10 is attached to one end of latch 8 proximate to nose 11 and at the other end thereof is attached to cam plate 7. Cam plate 7 is provided with two shallow depressions 12 and 13. An elbow shaped lever 17 swingably mounted about axis 16 is provided at one end thereof with roller means 14 and biasing spring 18 is attached to the other end thereof, whereby roller 14 is biased against the circumference of cam 7, causing roller 14 to lie in depressions 12 or 13 at particular points in the working cycle. There is further provided a rocker arm 19 rotatable about a fixed axle 20. Arm 19 is provided at one end thereof with roller 21 rotatably journaled thereinto and at the other end thereof with anchor 22. Proximate to anchor 22 is provided an electromagnet 23 actable upon said anchor. Spring 24 is provided to arm 19 between axis 20 and anchor 22. Control block 25 is provided on the spring side of anchor 22. Between anchor 22 and axle 20, arm 19 is provided with a knee shaped protrusion 26.

In a manner similar to that provided to arm 19 there is provided from the location of axle 20, at approximately 180° about shaft 1 another fixed axle 30 about which another rocker arm 29 is rotatable. Arm 29 is provided at the short end thereof with a striker 36 and at the other end thereof with an anchor 32. Intermediate between axle 30 and anchor 32, roller 31 is rotatably journaled into arm 29. There is further provided, in a similar manner, an electromagnet 33 on the outside of anchor 32 and a stop means 35 on the other side of anchor 32. A biasing spring 34 is attached to arm 29 between roller 31 and anchor 32 to bias the anchor 32 against stop 35. Striker 36 located at the non anchor end of arm 29 is interactable with protrusion 27 of latch 8.

The cam plate 7 is provided with a protrusion 37. The electromagnets 23 and 33 are provided with cores 38 and 39 respectively, made out of permanent magnetic material, that is to say, material having extended magnetic capabilities with a very high coercive field strength. The electromagnets 23 and 33 are provided with windings 40 and 41, respectively, which are connected to a control program arrangement 42 thru leads 43 and 34, respectively. These windings are arranged so that upon activation they will counter-balance the permanent magnetic field. The program arrangement 42, as indicated schematically, is dependent upon the change in network potential in the same manner as drive motor 45 of the machine, since drive motor 45 is on the same circuit UW, as the program arrangement 42.

The environment illustrated in FIG. 2 is similar to that of FIG. 1 except that the shaft 1 is shown as having rotated 180° from the position illustrated in FIG. 1. Furthermore, in this embodiment the electromagnets here shown as 123 and 133, respectively, are provided, not with the permanent magnets of FIG. 1, but with conventional soft iron cores 138 and 139 and two sets of windings. Thus, in addition to the discharge windings 40 and 41 on magnets 123 and 133 there is provided to each of the electromagnets respectively, a second, activating, winding designated 46 and 47 respectively controlled by a network-independent power source 48 suitably a battery, to provide the permanent magnetic field.

The program arrangement 42, as is schematically illustrated, is provided with a bridge rectifier 49 for rectifying the full wave current and electronic switch 50 for passing the deactivation pulses. In this manner there are provided the discharge pulses (I) shown in the graph of FIG. 3. Thus, it is seen that there are provided a plurality of half-sine waves 51 of fairly substantial amplitude. The only thing that must be carefully considered is that the effective value of the pulse current does not exceed the thermal capacity of the electromagnets.

In the operation of the device, drive shaft 1 rotates either continuously or in predetermined intermittent time intervals by rotation of 180° each. In the embodiment of FIG. 1, in the first setting when anchor 22 is held by electromagnet 23, knee shaped protrusion 26 interacts with protrusion 27 on lever 8 to hold nose 11 out of interaction with slots 2 or 3. When program controller 42 provides a deactivating pulse (I) via lead 43 to the electromagnetic windings 40 (and 41) the permanent magnetic field of the corresponding magnets is either totally or substantially neutralized to the extent that the bias of spring 24 (and 34 respectively) is sufficient to remove anchors 22 (and 32) from the influence of the magnets.

The arm 19 is pulled from the illustrated first positon by the bias of spring 24 into the second position in which latch 8 is thus released from arm 19 and nose 11 interacts with groove 2. Thus, the cam element 5 is caused to rotate with main shaft 1, whereby in turn protrusion 37 will interact with roller 31 of the arm 29 and move this from the illustrated second position into the first position in which the anchor 32 is presented to and retained by electromagnet 33 in consequence thereof. As illustrated in FIG. 2, protrusion 27 of latch 8 is brought into interaction with striker 36 and thereby moving nose 11 out of slot 2. Cam element 5 was thus rotated 180°, and its exact position is controlled by action of detent mechanism 15 in which the positioning of roller 14 in the depression 13 of cam plate 7 locks the rotation of the cam plate. The next 180° rotation occurs when electromagnet 33 is provided with a deactivating pulse at which time protrusion 37 will move roller 21 of rocker 19 into the first position, presenting anchor 22 to the pole of electromagnet 23 and locking this position by the presence of roller 14 in depression 12.

In the event of power failure, arms 19 and 29 will retain their setting at that time, hence the cam element 5, upon restoration of power, will have a well defined position. It is possible to provide eccentric cam 6 with an eccentric push rod by which the displacement of an element of a summing drive for the guide bar displacment is possible. In place thereof it is possible for the eccentric to influence a band to alter its effective length and in this way to influence the guide bar displacement. Furthermore, it is possible to provide a plurality of coupling means to drive shaft 1 which, acting together influence the patterning control.

We claim:

1. Electromagnetically controllable coupling means linking the drive shaft of a textile machine by a camming action for controlling rotation dependent motion of said machine comprising a pair of diametrically positioned longitudinal grooves in the circumferential surface of the drive shaft, cam means rotatable about said drive shaft, spring biased latch means rotatably mounted on said cam means, and having two opposing ends, said latch means having a nose for engaging one of said grooves at one end thereof, the other end thereof having a striker edge, a first and a second rocker arm rotatably mounted on fixed axes on opposing sides of said cam means, each of said rocker arms having a striker for engaging the striker edge of said latch means;

a first and second magnetically attractable anchor means attached to one end of said first and second rocker arms, respectively;

a first and second spring means attached to said rocker arm for biasing said first and second anchor means, a first and second programmable electromagnet disposed proximate to said first and second anchor means, respectively, each of said electromagnets having sufficient attractive force to hold its respective one of said anchor in contact therewith against the bias of said spring means, said cam means being operable to successively engage each of said rocker arms to move its anchor proximate to a corresponding one of said electromagnets, means for holding said cam means in one of two predetermined positions;

long acting magnetic field means for continuously providing an electromagnetic force to each of said electromagnets, electromagnetic field neutralizing coil provided to said electromagnets for neutralizing the magnetic flux of said long acting magnetic field means, whereby upon activation of the neutralizing coil the anchor means are no longer held in contact with the electromagnets and the striker of one of said rocker arms is biased out of contact with said striker edge of said latch means whereby the nose of said latch is biased into engagement with one of said grooves in said shaft whereby said cam means is rotatable with said shaft.

2. Electromagnetically controllable coupling means in accordance with claim 1, the long acting magnetic field means being independent of the drive current of the machine.

3. Electromagnetically controllable coupling means in accordance with claim 2 wherein said electromagnets each comprise a core of permanently magnetic material.

4. Electromagnetically controllable coupling means in accordance with claim 1 wherein the electromagnets are each provided with a magnetizing winding and a source of direct current connected to said winding, said direct current source being independent of the power source for said machine.

5. An electromagnetically controllable coupling means in accordance with claim 1 wherein said cam means is provided with only one peripheral protrusion located substantially 180° from the nose of the latch means affixed to said cam means.

6. Electromagnetically controllable coupling means in accordance with claim 1 further including a pair of stopper plates proximate to respective strikers of said rocker arms and interactable therewith to predetermine a second setting position of said rocker arms.

7. Electromagnetically controllable coupling means in accordance with claim 1 wherein the activating current for the neutralizing winding is dependent upon the power circuit for the machine.

8. Electromagnetically controllable coupling means in accordance with claim 7 wherein the activation current for said neutralizing winding is provided by a series of pulses.

9. Electromagnetically controllable coupling means in accordance with claim 8 wherein the pulses are obtained by full wave rectification of the main power circuit supply.

* * * * *